US006390880B1

(12) United States Patent
Almazan

(10) Patent No.: US 6,390,880 B1
(45) Date of Patent: May 21, 2002

(54) RELIGIOUS BALLOONS AND STORAGE DEVICE

(76) Inventor: Rosa M. Almazan, 208 Otanes, Laredo, TX (US) 78046

( * ) Notice: Subject to any disclaimer, the term of this patent is extended or adjusted under 35 U.S.C. 154(b) by 0 days.

(21) Appl. No.: 09/573,970

(22) Filed: May 19, 2000

(51) Int. Cl.[7] ..... A63H 5/00; A63H 3/06

(52) U.S. Cl. ..... 446/81; 446/220; 206/457

(58) Field of Search ..... 446/75, 76, 77, 446/81, 220, 221, 223, 490; 281/22, 31, 29, 51; 283/117; 206/457, 459.5, 472, 232, 19

(56) References Cited

U.S. PATENT DOCUMENTS 1,655,341 A * 1/1928 Snellgrove
3,936,384 A 2/1976 Williams
5,035,391 A * 7/1991 Steele et al. ..... 248/346
D334,031 S 3/1993 Berwert
5,291,755 A 3/1994 Grant
5,514,022 A 5/1996 Harris
D374,619 S 10/1996 Cook
D407,125 S 3/1999 Hopkins
6,158,588 A * 12/2000 Conti ..... 206/457

* cited by examiner

*Primary Examiner*—D. Neal Muir

(57) ABSTRACT

A religious balloons and storage device for lifting the user's spirits and providing hope in times of need. The religious balloons and storage device includes a storage container having an open top, a bottom wall, side walls, and end walls; and also includes a cover hingedly attached to the storage container and being closeable upon the open top of the storage container; and further includes at least one inflatable balloon removably disposed within the storage container; and also includes at least one cord for fastening at least one inflatable balloon to the storage container.

8 Claims, 3 Drawing Sheets

RELIGIOUS BALLOONS AND STORAGE DEVICE

BACKGROUND OF THE INVENTION

1. Field of the Invention

The present invention relates to bible-grams and more particularly pertains to a new religious balloons and storage device for lifting the user's spirits and providing hope in times of need.

2. Description of the Prior Art

The use of bible-grams is known in the prior art. More specifically, bible-grams heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,291,755; 5,514,022; 3,936,384; U.S. Pat. No. Des. 407,125; U.S. Pat. No. Des. 334,031; and U.S. Pat. No. Des. 374,619.

While these devices fulfill their respective, particular objectives and requirements, the aforementioned patents do not disclose a new religious balloons and storage device. The inventive device includes a storage container having an open top, a bottom wall, side walls, and end walls; and also includes a cover hingedly attached to the storage container and being closeable upon the open top of the storage container; and further includes at least one inflatable balloon removably disposed within the storage container; and also includes at least one cord for fastening at least one inflatable balloon to the storage container.

In these respects, the religious balloons and storage device according to the present invention substantially departs from the conventional concepts and designs of the prior art, and in so doing provides an apparatus primarily developed for the purpose of lifting the user's spirits and providing hope in times of need.

SUMMARY OF THE INVENTION

In view of the foregoing disadvantages inherent in the known types of bible-grams now present in the prior art, the present invention provides a new religious balloons and storage device construction wherein the same can be utilized for lifting the user's spirits and providing hope in times of need.

The general purpose of the present invention, which will be described subsequently in greater detail, is to provide a new religious balloons and storage device which has many of the advantages of the bible-grams mentioned heretofore and many novel features that result in a new religious balloons and storage device which is not anticipated, rendered obvious, suggested, or even implied by any of the prior art bible-grams, either alone or in any combination thereof.

To attain this, the present invention generally comprises a storage container having an open top, a bottom wall, side walls, and end walls; and also includes a cover hingedly attached to the storage container and being closeable upon the open top of the storage container; and further includes at least one inflatable balloon removably disposed within the storage container; and also includes at least one cord for fastening at least one inflatable balloon to the storage container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence the technical disclosure of the application. The abstract is neither intended to define the invention of the application, which is measured by the claims, nor is it intended to be limiting as to the scope of the invention in any way.

It is therefore an object of the present invention to provide a new religious balloons and storage device which has many of the advantages of the bible-grams mentioned heretofore and many novel features that result in a new religious balloons and storage device which is not anticipated, rendered obvious, suggested, or even implied by any of the prior art bible-grams, either alone or in any combination thereof.

It is another object of the present invention to provide a new religious balloons and storage device which may be easily and efficiently manufactured and marketed.

It is a further object of the present invention to provide a new religious balloons and storage device which is of a durable and reliable construction.

An even further object of the present invention is to provide a new religious balloons and storage device which is susceptible of a low cost of manufacture with regard to both materials and labor, and which accordingly is then susceptible of low prices of sale to the consuming public, thereby making such religious balloons and storage device economically available to the buying public.

Still yet another object of the present invention is to provide a new religious balloons and storage device which provides in the apparatuses and methods of the prior art some of the advantages thereof, while simultaneously overcoming some of the disadvantages normally associated therewith.

Still another object of the present invention is to provide a new religious balloons and storage device for lifting the user's spirits and providing hope in times of need.

Yet another object of the present invention is to provide a new religious balloons and storage device which includes a storage container having an open top, a bottom wall, side walls, and end walls; and also includes a cover hingedly attached to the storage container and being closeable upon the open top of the storage container; and further includes at least one inflatable balloon removably disposed within the storage container; and also includes at least one cord for fastening at least one inflatable balloon to the storage container.

Still yet another object of the present invention is to provide a new religious balloons and storage device that can be easily taken to and used at special events.

Even still another object of the present invention is to provide a new religious balloons and storage device that gives the user a special greeting.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
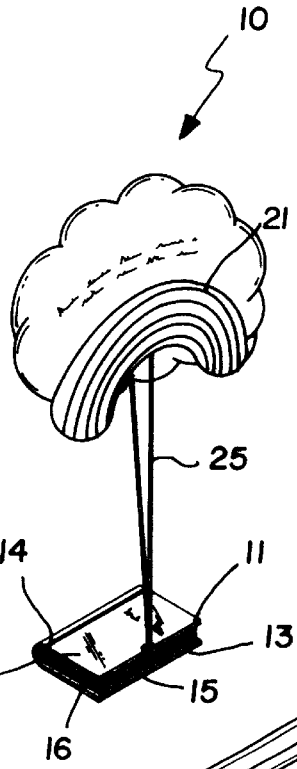
FIG. 1 is a perspective view of a new religious balloons and storage device according to the present invention shown in use.
Figure 2:
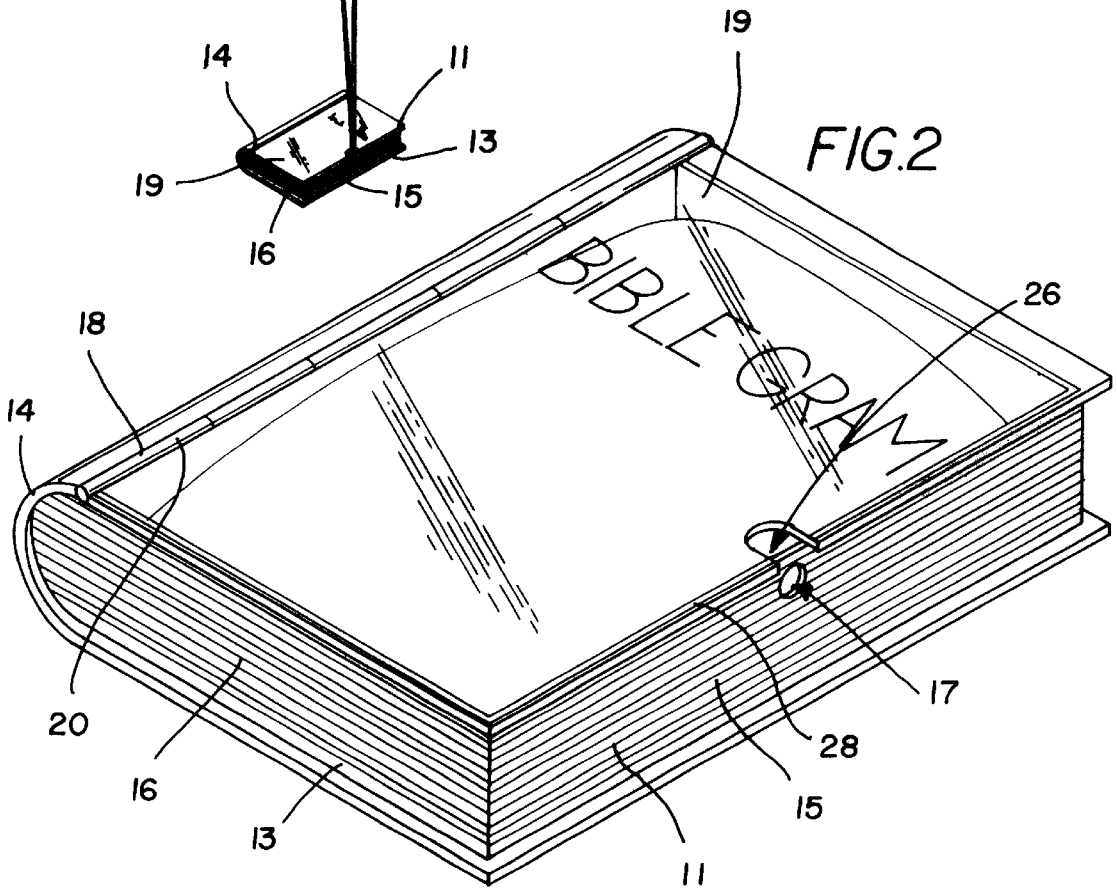
FIG. 2 is a perspective view of the storage container of the present invention.
Figure 3:
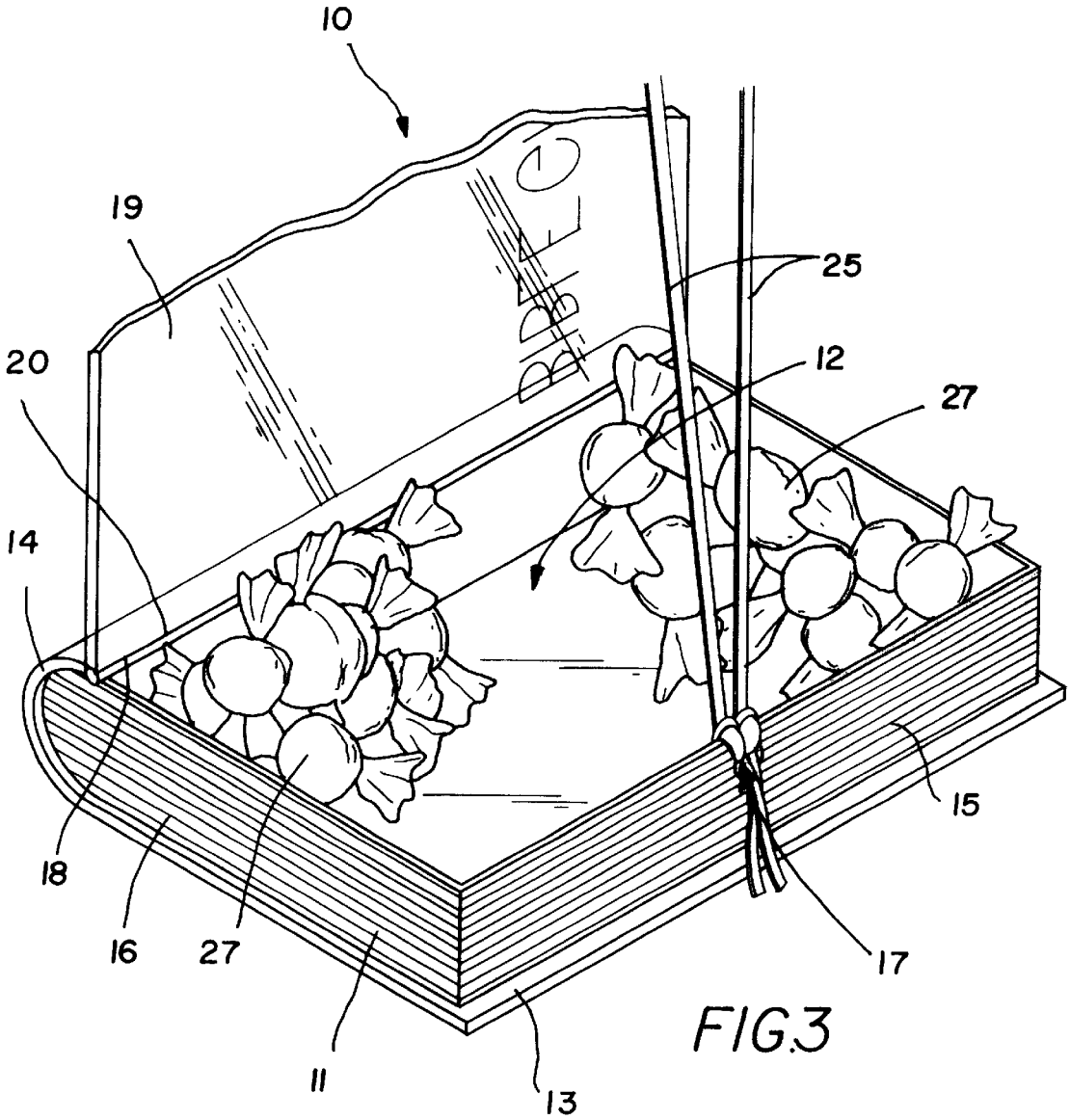
FIG. 3 is a perspective view of the present invention.
Figure 4:
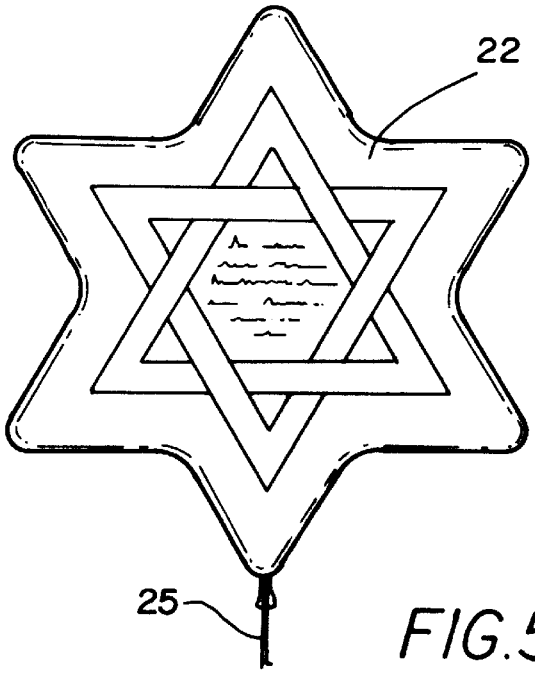
FIG. 4 is a side elevational view of a balloon of the present invention.
Figure 5:
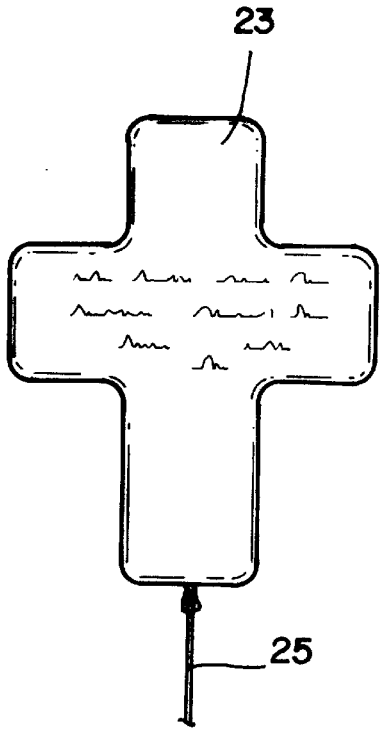
FIG. 5 is a side elevational view of another balloon of the present invention.
Figure 6:
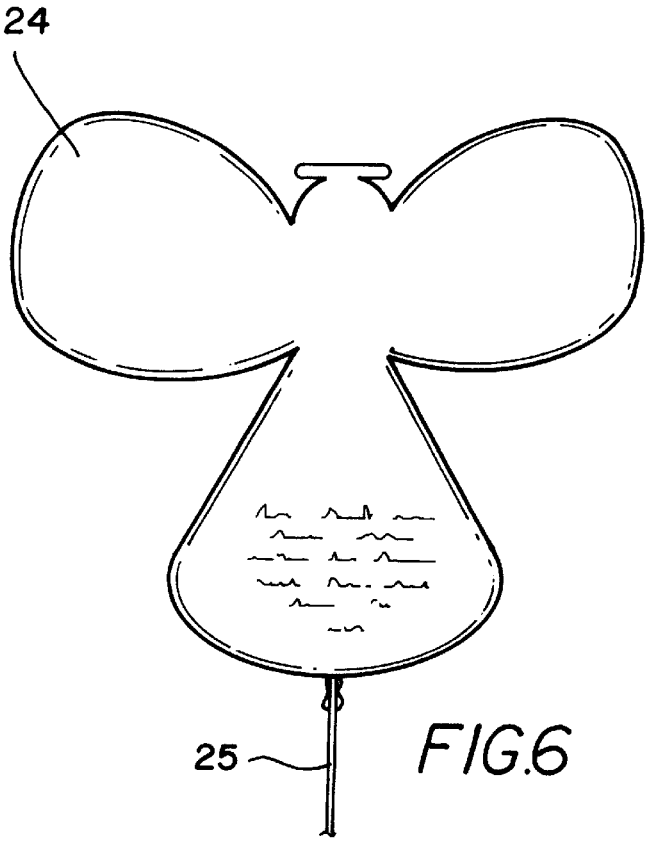
FIG. 6 is a side elevational view of yet another balloon of the present invention.

With reference now to the drawings, and in particular to FIGS. 1 through 6 thereof, a new religious balloons and storage device embodying the principles and concepts of the present invention and generally designated by the reference numeral 10 will be described.

As best illustrated in FIGS. 1 through 6, the religious balloons and storage device 10 generally comprises a storage container 11 having an open top 12, a bottom wall 13, side walls 14,15, and end walls 16. The side walls 14,15 of the storage container 11 include an arcuate side wall 14 which is integrally attached to the bottom wall 13, and also includes a second side wall 15 which is opposed to the arcuate side wall 14 and which has a hole 17 extending therethrough near a top thereof. The end walls 16 and the second side wall 15 are recedingly disposed relative to an outer edge of the bottom wall 13 with the storage container 11 being essentially shaped like that of a bible book. The storage container 11 is adapted to receive and store items 27 such as candy therein with the storage container 11 being approximately 5 inches long and 3 inches wide.

A cover 19 is hingedly attached to the storage container 11 and is closeable upon the open top 12 of the storage container 11 with the cover 19 including a first side edge 20 which is hingedly attached along a top edge 18 of the arcuate side wall 14 and with the cover also including a second side edge 28 having a slot 26 extending therein and being in alignment with the hole 17 in the second side wall 15. One or more inflatable balloons 21–25 are removably disposed within the storage container 11 with the one or more inflatable balloons 21–25 each having a distinctive shape which includes a rainbow shaped balloon 21, a star of David shaped balloon 22, a cross shaped balloon 23 and an angel shaped balloon 24, and also has religious scriptures imprinted thereupon. A tether-like means for fastening the one or more inflatable balloons 21–25 to the storage container 11 includes one or more cords 25 each being fastenable to the second side wall 15 through the hole 17 therein and being securely fastened to an inflatable balloon 21 through 24.

In use, the religious balloons and storage device 10 is ideally used at special events such as weddings and funerals where the user can open the cover 19 to the storage container 11 and remove and inflate and display a balloon or balloons 21 through 24 each having a distinctive shape and having selected scriptures imprinted thereupon for inspiration purposes for the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. Religious balloons and storage device comprising:

a storage container having an open top, a bottom wall, side walls, and end walls;

a cover hingedly attached to said storage container and being closeable upon said open top of said storage container;

at least one inflatable balloon removably disposed within said storage container; and a tether means for fastening said at least one inflatable balloon to said storage container;

wherein said side walls of said storage container includes an arcuate side wall which is integrally attached to said bottom wall, and also includes a second side wall which is opposed to said arcuate side wall and which has a hole extending therethrough near a top thereof.

2. Religious balloons and storage device as described in claim 1, wherein said end walls and said second side wall are recedingly disposed relative to an outer edge of said bottom wall.

3. Religious balloons and storage device as described in claim 1, wherein said storage container is shaped like a book.

4. Religious balloons and storage device as described in claim 1, wherein said cover includes a first side edge which is hingedly attached along a top edge of said arcuate side wall, said cover also including a second side edge having a slot extending therein and being in alignment with said hole in said second side wall.

5. Religious balloons and storage device as described in claim 1, wherein said at least one inflatable balloon has a shape selected from the group of shapes consisting of a generally semicircular rainbow shaped balloon, a star of David hexagram-shaped balloon, and a cross shaped balloon.

6. Religious balloons and storage device as described in claim 1, wherein said tether means includes at least one cord being fastenable to said second side wall through said hole therein and being securely fastened to said at least one inflatable balloon.

7. Religious balloons and storage device as described in claim 1, wherein said storage container is adapted to receive and store items therein.

8. Religious balloons and storage device comprising:

a storage container having an open top, a bottom wall, side walls, and end walls, said side walls of said storage container including an arcuate side wall which is integrally attached to said bottom wall, and also including a second side wall which is opposed to said arcuate side wall and which has a hole extending therethrough near a top thereof, said end walls and said second side wall being recedingly disposed relative to an outer edge of said bottom wall, said storage container being shaped like a book, said storage container being adapted to receive and store items therein, said storage container being approximately 5 inches long and 3 inches wide;

a cover hingedly attached to said storage container and being closeable upon said open top of said storage container, said cover including a first side edge which is hingedly attached along a top edge of said arcuate side wall, said cover also including a second side edge having a slot extending therein and being in alignment with said hole in said second side wall;

at least one inflatable balloon removably disposed within said storage container; and a tether means for fastening said at least one inflatable balloon to said storage container, said tether-like means including at least one cord being fastenable to said second side wall through said hole therein and being securely fastened to said at least one inflatable balloon.

* * * * *